US005616016A

United States Patent [19]

Hill et al.

[11] Patent Number: 5,616,016

[45] Date of Patent: Apr. 1, 1997

[54] PRESSURE BIASED CO-ROTATIONAL SCROLL APPARATUS WITH ENHANCED LUBRICATION

[75] Inventors: Joe T. Hill, Whitehouse; John R. Williams, Tyler; Robert E. Utter, Whitehouse, all of Tex.; Gene M. Fields, Bristol, Tenn.

[73] Assignee: Alliance Compressors, Tyler, Tex.

[21] Appl. No.: 517,932

[22] Filed: Aug. 22, 1995

Related U.S. Application Data

[62] Division of Ser. No. 299,692, Sep. 1, 1994, Pat. No. 5,462,419, which is a division of Ser. No. 125,684, Sep. 22, 1993, Pat. No. 5,449,279.

[51] Int. Cl.[6] ..... F01C 1/04; F01C 21/04; F04C 18/04; F04C 29/02

[52] U.S. Cl. ..... 418/55.4; 418/55.5; 418/55.6; 418/57; 418/88; 418/99

[58] Field of Search ..... 418/55.4, 55.5, 418/55.6, 57, 88, 98, 99

[56] References Cited

U.S. PATENT DOCUMENTS

| | | | |
|---|---|---|---|
| 5,101,644 | 4/1992 | Crum et al. | 418/55.6 |
| 5,129,798 | 7/1992 | Crum et al. | 418/55.5 |
| 5,199,280 | 4/1993 | Riffe et al. | 418/55.5 |
| 5,242,284 | 9/1993 | Mitsunaga et al. | 418/55.5 |

FOREIGN PATENT DOCUMENTS

| | | | |
|---|---|---|---|
| 3-11183 | 1/1991 | Japan | 418/88 |
| 5126073 | 5/1993 | Japan | 418/55.6 |

*Primary Examiner*—John J. Vrablik
*Attorney, Agent, or Firm*—William J. Beres; William O'Driscoll; Peter D. Ferguson

[57] ABSTRACT

A high side co-rotational scroll compressor has lubricant sumps in both the discharge and suction pressure portions of its hermetic shell as well as a pressure biasing arrangement by which the scroll members are urged together in operation to minimize internal leakage. Lubrication of the bearing in which the driven scroll member rotates as well as to the bearing in which the idler scroll member rotates, both of which are located in the suction pressure portion of the shell, is provided for. Additionally, embodiments are taught by which the interface between the tips of the wraps of each scroll member and the end plate of the opposing scroll member are lubricated and by which the seal in the axial pressure biasing arrangement is lubricated and/or shielded from debris having the potential to damage it.

12 Claims, 6 Drawing Sheets

FIG. 2
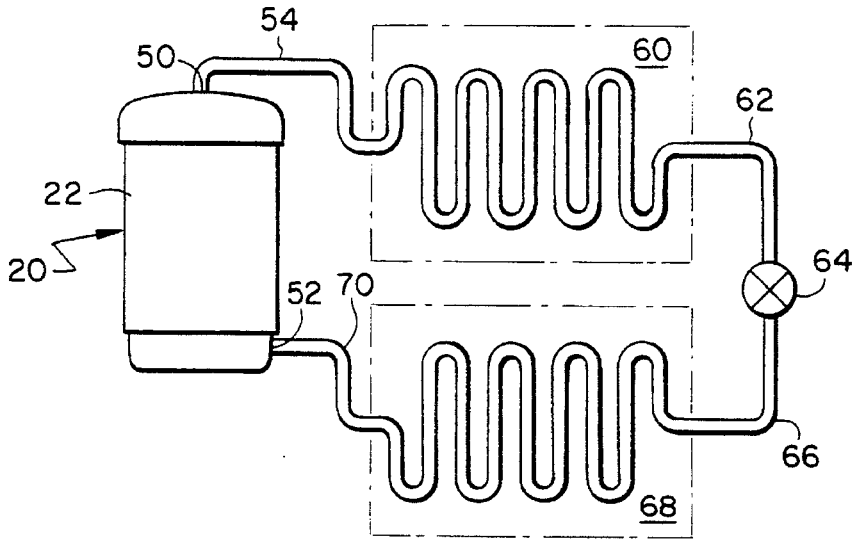
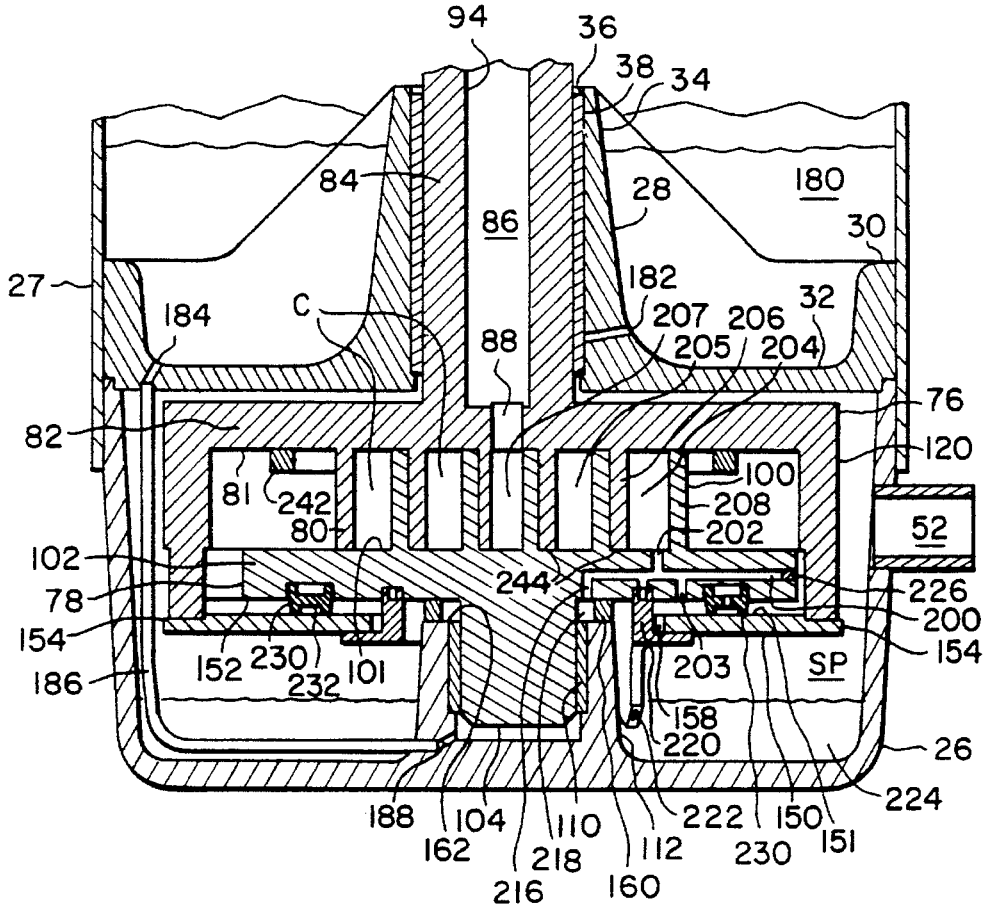
FIG. 3

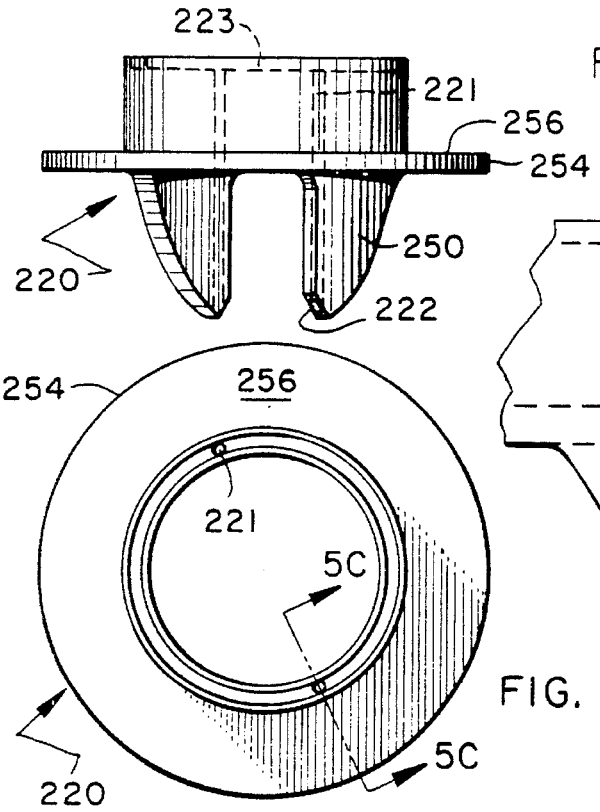
FIG. 5A
FIG. 5B
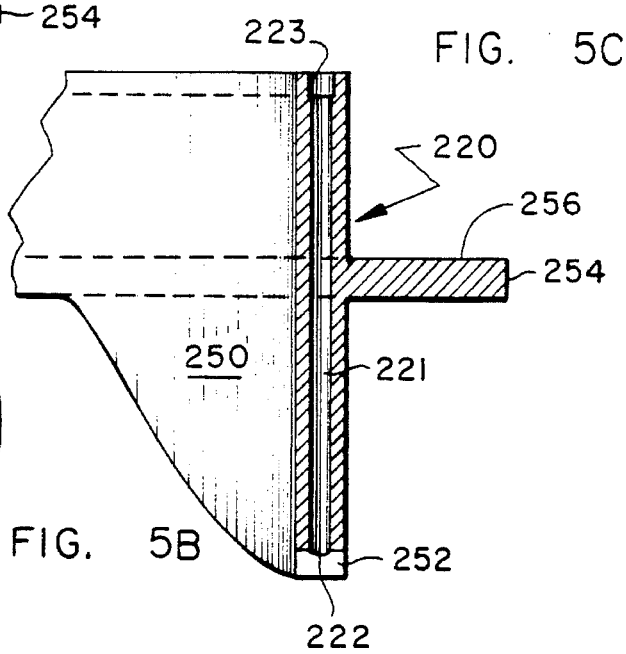
FIG. 5C
FIG. 9
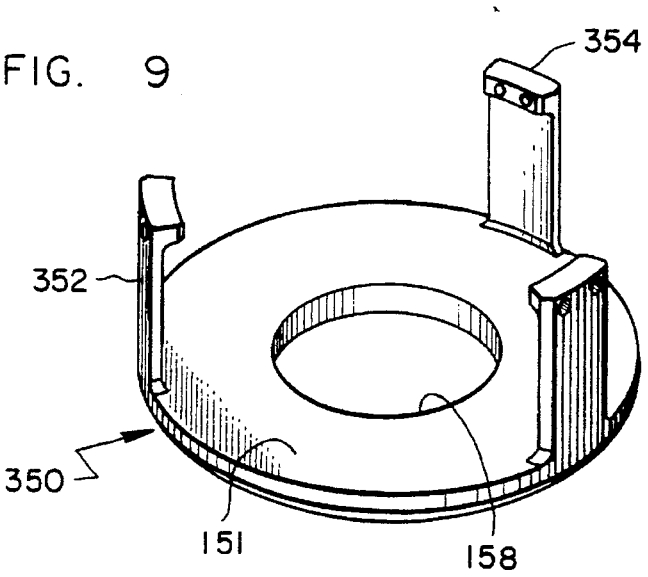

PRESSURE BIASED CO-ROTATIONAL SCROLL APPARATUS WITH ENHANCED LUBRICATION

This application is a division of application Ser. No. 08/229,692 filed Sep. 1, 1994, U.S. Pat. No. 5,462,419, and which itself is a division of Ser. No. 08/125,684, now U.S. Pat. No. 5,449,279, Filed on Sep. 22, 1993.

TECHNICAL FIELD

The subject invention pertains to co-rotating scroll apparatus. More particularly, this invention pertains to apparatus for delivering oil to selected locations in a co-rotating scroll compressor for lubrication and sealing purposes.

BACKGROUND ART

Scroll apparatus for fluid compression or expansion is typically comprised of two upstanding and interleaved involute wraps. Each involute wrap extends from an end plate and has a tip disposed in contact or near-contact with the surface of the end plate from which the other scroll wrap extends. Each scroll wrap also has flank surfaces which adjoin in moving line contact, or near contact, with the flank surfaces of the other scroll wrap to define, in cooperation with the scroll end plates, a plurality of moving chambers.

Depending upon the direction of orbital motion of the scroll wraps, the chambers move radially inward from the exterior of the interleaved scroll wraps for fluid compression or radially outward from the interior of the interleaved wraps for fluid expansion. The scroll wraps, in order to accomplish the formation and movement of the chambers, are placed in relative orbital motion by a drive mechanism.

Several attempts have apparently been made to develop co-rotational scroll apparatus. Such apparatus provides for concurrent rotary motion of both scroll wraps on parallel offset axes to generate the requisite orbital motion between the wrap elements. However, most scroll apparatus to date and compressors in particular have been of the type having one fixed and one orbiting scroll due to various and many difficulties and complexities associated with co-rotating scroll apparatus. In that regard, no commercially available co-rotating scroll compressors are known to exist despite the many theoretical advantages offered by a co-rotating scroll compressor over a scroll compressor of the type in which one of the scroll members is fixed.

Notable with respect to Background Art are U.S. Pat. Nos. 801,182; 3,600,114 and 4,178,143. The '182 patent teaches the concept of co-rotating scroll apparatus and indicates that the basic concept is relatively old. The '114 and '143 patents are suggestive of other still relatively early attempts to design co-rotating scroll apparatus although, in each case, apparatus the purpose of which is to act as a pump or a motor rather than as a compression apparatus.

Also noteworthy is an effort undertaken by Sundstrand Corporation, as evidenced by a series of patents issuing in the mid-1980's to develop co-rotating scroll compression apparatus. Of particular note with respect to the present invention is Sundstrand's U.S. Pat. No. 4,600,369 which is discussed below.

More recently, interest in the commercialization of co-rotating scroll apparatus has been evidenced by the patent activity of the assignee of the present invention, Arthur D. Little Inc. and Mitsubishi Denki. Several other internationally known business entities have indicated an interest in developing co-rotating scroll compressor technology as evidenced by the issuance of patents in the U.S. and foreign countries. Co-rotating scroll technology would therefore appear to be poised for rapid and extensive international development and commercialization although, once again, no commercially available co-rotating scroll compression apparatus are known to be available as of the filing date hereof. With respect to the present invention, the following patents are deemed to be of interest.

U.S. Pat. No. 4,600,369 discloses one biasing arrangement for counteracting the pressure developed in the compression chambers defined by the scroll wraps of a co-rotating scroll compressor. That pressure tends to force the two scrolls axially apart thereby encouraging leakage and a loss in compressor efficiency. The arrangement of the '369 patent includes an element which rotates with the idler scroll member and which defines a pressure chamber for urging the scroll members axially together against the pressure developed in the compression chambers between the scroll members. The element carries a set of seals which bear against the driven scroll member to seal the pressure chamber.

U.S. Pat. No. 4,927,339, assigned to the assignee of the present invention and incorporated herein by reference, likewise discloses various arrangements in co-rotational scroll apparatus for axial biasing scroll members toward each other including arrangements making use of a biasing element which rotates with the drive scroll member.

U.S. Pat. No. 5,129,798, likewise assigned to the assignee as the present invention and incorporated herein by reference, provides for improved biasing of the idler scroll toward the drive scroll in co-rotational scroll apparatus. In the '798 patent, a pressure plate carried by the drive scroll is disposed adjacent the underside of the idler scroll end plate. A seal, carried by the idler scroll, is disposed in a recess in the underside of the idler scroll end plate and is controllably pressure biased into engagement with the pressure plate thereby biasing the idler scroll toward the drive scroll.

U.S. Pat. No. 5,212,964, assigned to the assignee of the present invention, meets, on the other hand, the need for lubrication between the tips of the involute wraps of the drive and idler scrolls and the opposed end plates. Pickup tubes that rotate with the idler scroll member direct lubricant from a lubricant sump to a passage in the end plate of the idler scroll. The lubricant flows radially outward in the passage and is discharged through a port defined on the involute wrap side of the end plate of the idler scroll member so as to lubricate the interface between the tip of the drive scroll involute wrap and the end plate of the idler scroll.

Notwithstanding the above noted improvements in the design of co-rotating scroll apparatus and the teachings of the above-mentioned patents, there remains a need to provide for adequate lubrication in such a compressor, including lubrication of the seal in axial pressure biasing arrangements, a need to protect that seal from potentially damaging debris and a need to simultaneously provide adequate lubrication to bearings and other surfaces within the apparatus, before commercialization of such apparatus becomes viable.

Therefore, it is an object of the present invention to provide co-rotational scroll apparatus having improved lubrication and an axial pressure biasing arrangement which minimally effects the overall efficiency of the apparatus.

It is yet another object of the present invention to provide a co-rotational scroll compressor in which a controlled, effective and adequate flow of lubricant therethrough is maintained, including lubricant flow to the compressor's bearings, scroll member interface surfaces and the seal in the compressor's axial pressure biasing arrangement.

It is yet another object of the present invention to provide a scroll compressor where a pressure biasing seal is provided lubrication and is protected from potentially damaging debris, all in a manner which is efficient and relatively inexpensive to implement.

These and other objects of the present invention will be apparent from the attached drawings and the Description of the Preferred Embodiment which follows.

SUMMARY OF THE INVENTION

The subject invention is scroll apparatus having two concurrently rotating scroll members (a drive scroll and an idler scroll), each member having an involute wrap in interleaving engagement with the wrap of the other. The scroll members are disposed and operate in a hermetic shell which is provided with a suction inlet for a fluid such as a refrigerant.

The scroll elements are oriented so that their rotational axes are generally vertical, offset and parallel. The drive scroll carries a pressure plate which allows for the axial biasing of the scroll members toward each other by means of a pressurized seal disposed between the idler scroll member and the pressure plate. The pressure plate may be a unitary member connected to and carried by the drive scroll member.

The idler scroll member defines a passage through which lubricant is distributed. One or more branch passages provides for lubricant distribution within the compressor including one which deposits a metered quantity of lubricant onto the pressure plate radially inward of the seal of the pressure biasing arrangement. Centrifugal force, caused by the rotation of the pressure plate, urges the lubricant deposited on the pressure plate radially outward until it comes in contact with the seal. A portion of the lubricant is swept under the seal thereby lubricating the seal-to-pressure plate interface.

Lubricant is provided to the supply passage defined in the idler scroll member by a lubricant pickup member which is attached to, rotates with and depends from the idler scroll end plate into a lubricant sump. The pickup member shields the seal from debris which might otherwise make its way onto the pressure plate and result in damage to the seal. Alternatively and/or additionally, the supply passage in the idler scroll may be provided lubricant from a sump in the discharge pressure portion of the compressor via integrally formed lubricant passages which open into the bearing housing in which the idler scroll member is rotatably supported.

BRIEF DESCRIPTION OF THE DRAWINGS

FIG. 2 is in schematic depiction of a closed circuit system such as a refrigeration or air conditioning system in which the subject invention may suitably be employed.

FIG. 3 is an enlarged view of the rotating scroll elements of the scroll apparatus of FIG. 1.

FIGS. 5*a*, 5*b* and 5*c* fully illustrate the unitary lubricant pickup member of FIGS. 1, 3 and 4.

FIG. 9 illustrates a unitary design for the pressure plate portion of the pressure biasing apparatus.

DESCRIPTION OF THE PREFERRED EMBODIMENT

Figure 1:
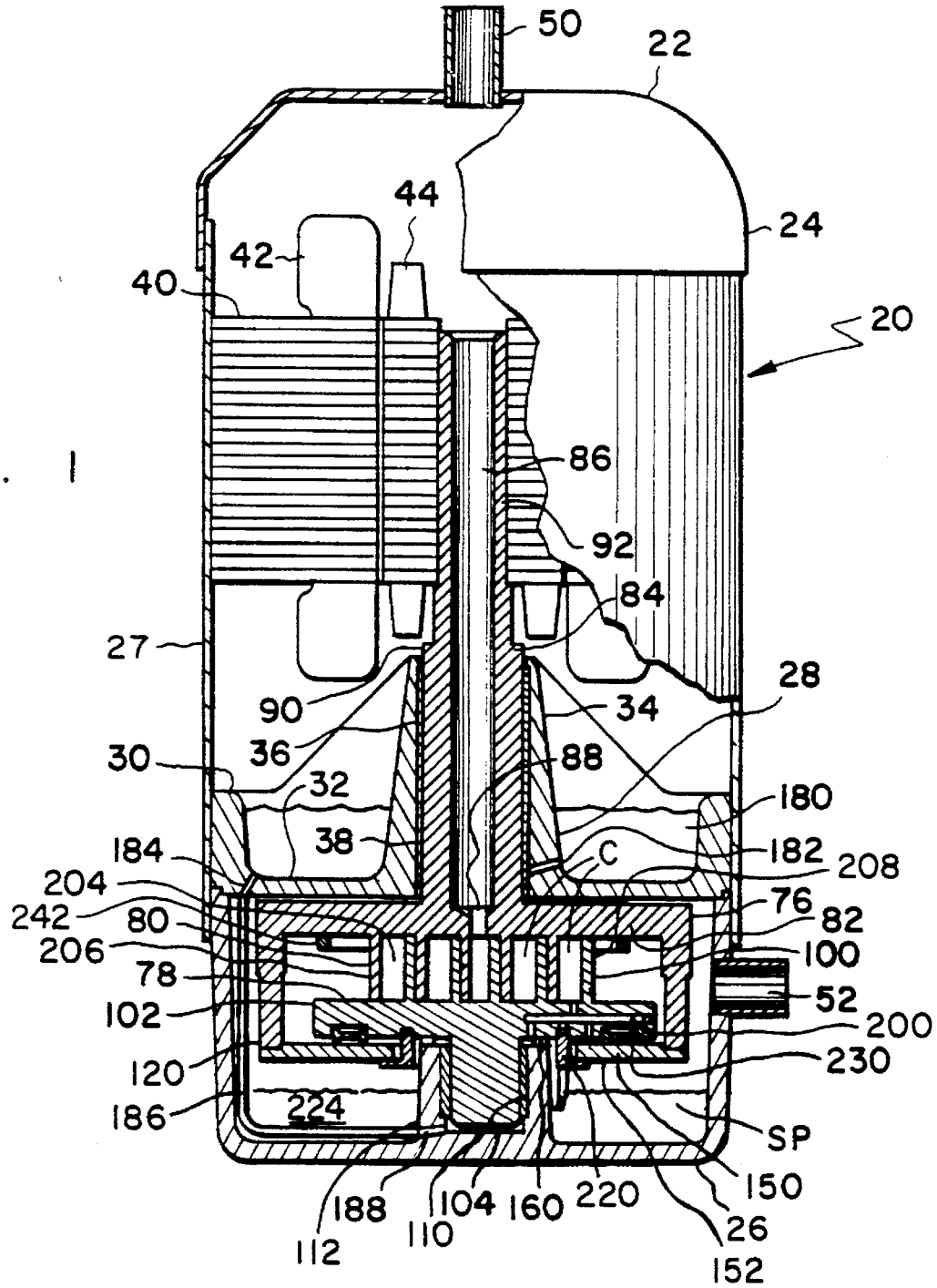
FIG. 1 is a sectional view of a co-rotational scroll apparatus embodying the enhanced lubrication system of the subject invention.

Co-rotational scroll apparatus, shown in FIG. 1 as a scroll compressor assembly, is referred to by reference numeral 20. As the preferred embodiment of the subject invention is a hermetic refrigerant gas compressor, compressor assembly 20 is illustrated and described in terms of a hermetic scroll compressor but is interchangeably referred to as a scroll apparatus or assembly or compressor. It will be apparent to those skilled in the art that the features of the subject invention may be employed in scroll apparatus used as a fluid pump or expander and in scroll compressors not of the hermetic type.

In a first embodiment, compressor assembly 20 includes a hermetic shell 22 having an upper portion 24, a lower portion 26, a central shell portion 27 and an intermediate, central frame portion 28 affixed within the central shell 27. Central frame portion 28 separates high and low pressure regions within shell 22 as will further be described.

Central shell 27 is a generally cylindrical body while central frame portion 28 has a generally cylindrical or annular exterior portion 30 and a central portion 32. The annular exterior portion 30 of the central frame portion 28 is sized to fit sealingly within exterior shell 27 so that it can be mated thereto by press fit, welding, electromagnetic deformation or by other suitable means.

Integral with central frame portion 28 is a generally cylindrical upper bearing housing 34 which is preferably coaxial with exterior portion 30. A drive shaft aperture 36 extends axially through the center of the upper bearing housing 34 and an upper main bearing 38 is disposed therein. Preferably, upper bearing 38 is a sleeve bearing made of sintered bronze or a similar material although it may be of a rolling element type.

Electric motor 40 is disposed within central shell portion 27 of shell 22 and is comprised of a stator 42 which is disposed about a rotor 44. An annular space defined therebetween permits free rotation of the rotor 44 as well as the flow of fluid, such as refrigerant gas in which lubricant is entrained, therethrough and around. Stator 42 may be affixed within the exterior shell 27 by press fit, bolts (not shown), weldments (not shown) or by other means.

An aperture 50 is defined in the upper portion of shell 22 for discharging compressed gas from the apparatus and an aperture 52 is defined in the lower portion of the shell for receiving suction pressure gas into the apparatus. This permits connection of compressor 20 to the refrigeration system schematically represented in FIG. 2.

The system of FIG. 2 includes a discharge line 54 connected between discharge aperture 50 of compressor 20 and a condenser 60 as well as a line 62 which connects condenser 60 to an expansion device 64. The expansion device may be thermally or electrically actuated or may be comprised of one or more capillary tubes. An additional line 66 connects expansion device 64 to evaporator 68 where heat is transferred from a refrigeration load to the refrigerant within the system. Finally, a suction line 70 transfers refrigerant gas, which has been heated by the refrigeration load and which is at a suction pressure, from the evaporator 68 to the compressor 20. It will be apparent to those skilled in the art that it is contemplated that the refrigeration or air conditioning system of FIG. 2 may include multiple units of the compressor assembly 20 as well as multiple condensers or evaporators and/or other components.

Referring now to FIGS. 1 and 3, scroll compressor assembly 20 includes a drive scroll member 76 and an idler scroll member 78. The first or drive scroll member 76 has an involute wrap 80 which is integral with and extends from surface 81 of generally planar end plate 82. An integral drive shaft 84 extends from end plate 82 in a direction opposite that from which scroll wrap 80 extends. A discharge gallery 86 is defined by a bore extending through drive shaft 84 and is in flow communication with a discharge port 88 defined by end plate 82. Drive shaft 84 preferably includes a first, relatively larger diameter bearing portion 90, carried in upper main bearing 38, and a second relatively smaller diameter rotor portion 92 fixedly disposed in motor rotor 44.

The second or idler scroll member 78 has an upstanding involute wrap 100 which extends from surface 101 of idler scroll end plate 102 and which is in interleaving engagement with involute wrap 80 of the drive scroll member. Idler scroll member 78 also has a stub shaft 104 which extends from end plate 102 in a direction opposite that from which involute wrap 100 extends. An annular bearing 110, which may be a sleeve bearing or a bearing of the rolling element type, is disposed within a lower bearing housing 112. Lower bearing housing 112, which may be integral with shell portion 26 or formed in a separate component, rotatably supports idler scroll member 78.

Drive scroll end plate 82, in the preferred embodiment, has two members 120 extending from it in the same direction and parallel to scroll wrap 80. Extension members 120 are disposed at radially opposed positions near the outer periphery of drive scroll end plate 82 and are of a length such that they extend past interleaved scroll wraps 80 and 100 as well as idler scroll end plate 102.

Members 120 are affixed to a pressure plate 150 and provide one of several contemplated means for permitting the drive scroll member to rotatably carry the pressure plate member. Extension members 120 may be accommodated in a peripheral recess in pressure plate 150 and may be attached thereto by conventional means. It will be recognized that in the alternative, extension members 120 may be integral with pressure plate 150 and be fixedly attached to drive scroll end plate 82 as will be described with respect to FIGS. 8 and 9.

Although pressure plate 150 will preferably be carried by the drive scroll member, it is contemplated that plate 150 can be driven other than by or through the drive scroll member. In that regard, it is contemplated and within the scope of the present invention that a separate power transmission mechanism be disposed in compressor 20 through which pressure plate 150 is rotatably driven. It is also contemplated that pressure plate 150 could be carried by the idler scroll member for pressure biasing interaction with the end plate of the drive scroll member.

As has been indicated, pressure plate 150 is an annular member fixedly attached to drive scroll member 76. Plate 150 is disposed adjacent to, but spaced apart from, idler scroll end plate 102 and presents a flat pressure responsive surface 151 to undersurface 152 of the idler scroll member. Pressure plate 150 also defines a central aperture 158 which is of greater diameter than lower bearing housing 112 thereby permitting the pressure plate to rotate freely about the bearing housing. An annular thrust bearing 160 may be disposed on shoulder 162 of the idler bearing housing 112 for supporting the weight of the scroll members 76 and 78 as well as that of drive shaft 84 and rotor 44 when the compressor is at rest and, to a lesser extent, when it is in operation.

A high pressure lubricant sump 180 is provided above central portion 32 of frame 28. In operation, discharge pressure lubricant laden refrigerant is discharged from the scroll set through gallery 86 into the discharge pressure portion of shell 22 where the lubricant is disentrained from the refrigeration gas and falls into sump 180. As has been described, the lubricant therein, like the remainder of the interior of shell 22 located above frame 28, is at discharge pressure when the compressor is in operation.

Discharge pressure and gravity drive lubricant from sump 180 to the upper bearing 38 through a lubricant bore 182 in bearing housing 34. With respect to lower bearing 110, bore 184 provides flow communication through frame 28 for discharge pressure lubricant to flow from sump 180 to lubricant feed tube 186 and thence, through passage 188 of bearing housing 112 and volume 189 beneath idler scroll stub shaft 104, to bearing 110.

It is to be noted that the passage defined by tube 186 can be integrally cast into frame 28 and lower shell portion 26 or into a separate lower bearing housing if one is employed and that it need not be defined by a separate tubular member. It is also to be noted that upper bearing 38 and lower bearing 110 are sized with respect to their housings 34 and 112 and the scroll member shafts which rotate within them so that the flow of lubricant into the suction pressure portion SP of shell 22, after it has passed through and out of the respective upper and lower main bearings due to the pressure differential across them, is controlled in quantity.

Figure 4:
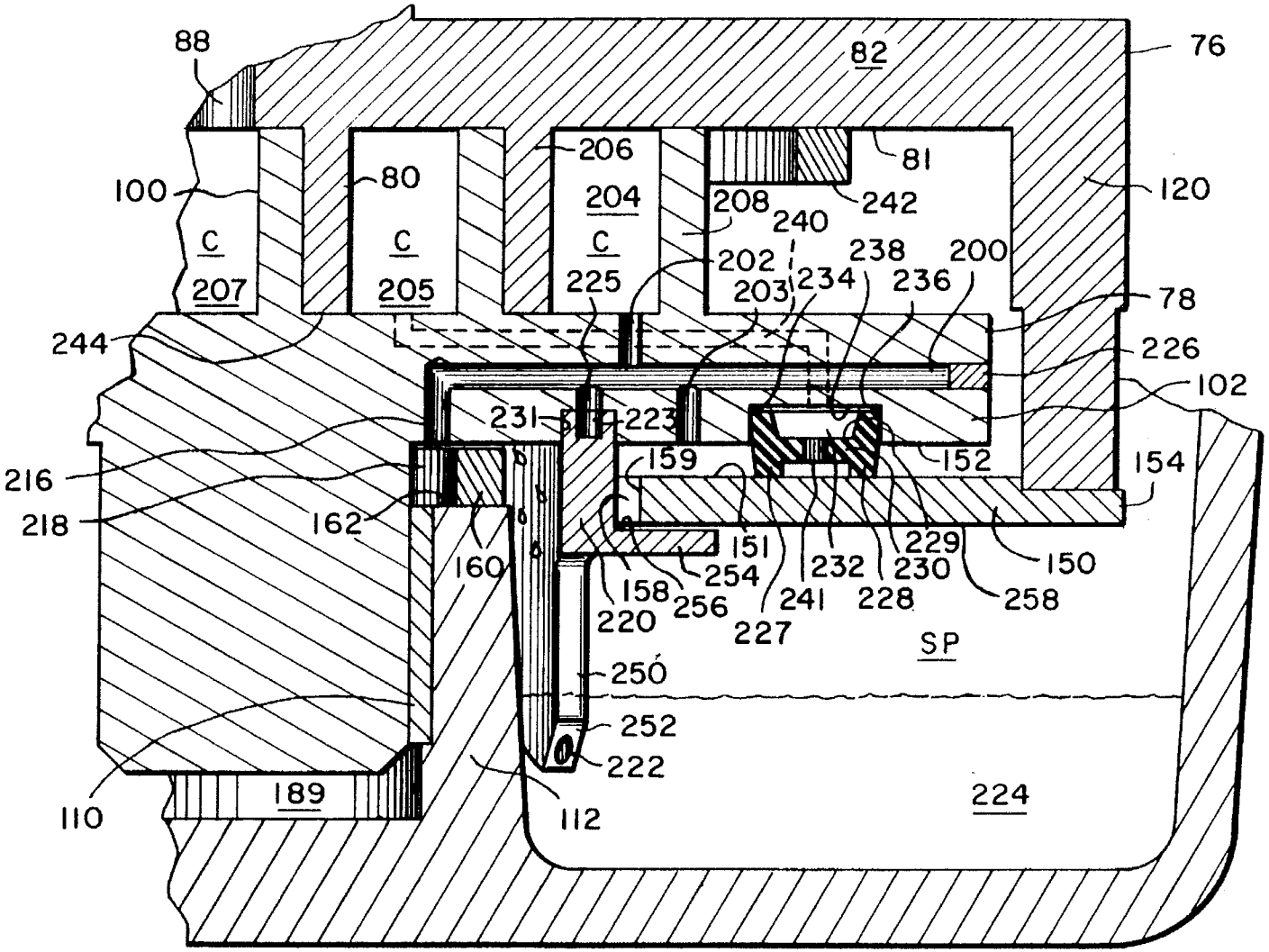
FIG. 4 is a further enlarged view of FIGS. 1 and 3 better depicting the unitary lubricant pickup member, lubricant passages, pressure seal between the idler scroll and pressure plate and their interaction in the scroll apparatus of the FIG. 1 embodiment of the present invention.

Referring primarily now to FIGS. 3, 4 and 5, one or more lubricant passages 200 extend radially outward in the idler scroll end plate 102. A lubricant passage outlet 202 permits lubricant to flow from passage 200 to radially outermost first compression chamber 204 formed by the radially outer end portions 206 and 208 of scroll wraps 80 and 100. An intermediate pressure compression chamber 205 is radially inward of chamber 204 with discharge chamber 207 being the radially innermost of the compression chambers. A descending branch passage 203 permits the flow of lubricant, in a metered quantity, from lubricant passage 200 onto surface 151 of pressure plate 150 as will further be described.

A first inlet 216 to lubricant passage 200 may be provided at its radially inward end. Inlet 216 receives lubricant from a lubricant collection chamber 218 defined between the idler scroll end plate 102, stub shaft 104 and The thrust bearing 160. Inlet 216 thus comprises one means for delivering lubricant to lubricant passage 200. It will be remembered that oil delivered to bearing 110 is at discharge pressure and that the differential pressure across the bearing will drive oil from space 189 beneath the stub shaft to chamber 218. Such oil, after having passed through bearing 110 emerges into collection chamber 218 which is at suction pressure. The centrifugal force generated by the rotation of the idler scroll as well the pressure differential across bearing 110 will serve to continuously "feed" oil to collection chamber 218, urge lubricant radially outward within passage 200 and assist in its delivery to locations requiring lubrication.

A second inlet to lubricant passage 200 is through lubricant pickup member 220 which has an inlet 222 in the distal end of a bladelike portion that depends into lubricant sump 224 in the suction pressure portion SP of scroll apparatus 20. It is important to note that one or both of lubricant passage inlet 216 or inlet 222 of pickup member 220 may be employed in the delivery of lubricant to passage 200 and one or both may be referred to as inlets to lubricant passage 200. Plug 226 closes the radially outer end of the lubricant passage 200 which is drilled into the periphery of idler scroll end plate 102.

The forces created by the fluid compression process which occurs within the compression chambers formed between the scroll members are forces that tend to push the scroll members axially apart and vary cyclically as the scroll members 76, 78 co-rotate. This cyclic variation of the separation forces is a function of the instantaneous location of the compression chambers during each revolution of the scroll members and the instantaneous pressure within those compression chambers which differs one from the other in the radial direction.

These factors, together with the offset axes of the co-rotating scroll members, combine to produce a torque or moment with respect to the rotational axes of the scroll members, as is described in U.S. Pat. Nos. 5,099,658 and 5,142,885, assigned to the assignee of the present invention and incorporated herein by reference. Such torque can cause the tipping of the scroll members and, in particular, the idler scroll member which, by its nature, has a somewhat less substantial bearing arrangement than the drive scroll member. An annular seal 230 is therefore incorporated in the apparatus 20 as part of an axial pressure biasing arrangement one purpose of which is to counteract and offset the tendency of the scroll elements to separate and/or tip.

As is most clearly illustrated in FIG. 4, annular pressure chamber 232 is defined in undersurface 152 of idler scroll end plate 102 by seal 230, radially inner wall 234, radially outer wall 236 and a wall 238 of the idler scroll member which joins the radially inner and outer walls 234 and 236. Both the inner wall 234 and the outer wall 236 are preferably perpendicular to undersurface 152 of the idler scroll member so that, together with the wall 238, they define a recess in undersurface 152 of the idler scroll member which is rectangular in cross section.

At least one pressure fluid passage 240, shown in phantom in FIG. 4 and which is different from lubricant passage 200, is defined in idler scroll end plate 102 to permit the communication of pressure from one of the compression chambers C, defined between the scroll wraps of the drive and idler scroll members, to pressure chamber 232. In the embodiment of FIG. 4, a pressure intermediate suction and discharge pressure is communicated from intermediate pressure compression chamber 205 to pressure chamber 232.

The pressure communicated through passage 240 biases idler scroll 78 toward drive scroll 76 by the pressing of seal 230 against pressure plate 150. Seal 230 is preferably H-shaped in cross-section having a first leg 227 and a second leg 228 which are joined by a central span 229. As is taught in assignee's U.S. Pat. No. 5,129,798, seal 230 may define an aperture 241 in span 229. Where seal 230 defines an aperture, it is characterized as a "vented" seal. Where span 229 is solid, as is illustrated and described with respect to FIG. 6 as described below, seal 230 is characterized as an "unvented" seal.

It is preferable to form seal 230 from a somewhat flexible material so that the buildup of pressure within chamber 232 ensures fluid tight contact between seal 230 and walls 234 and 236. Seal 230 must also be in reasonably free sliding engagement with the respective inner and outer wall surfaces 234 and 236 of the idler scroll end plate while at the same time maintaining a skating but sealed interface between the idler scroll member and pressure plate 150.

In operation, the energization of motor 40 causes the concurrent rotation of drive scroll member 76 and idler scroll member 78 through the operation of an Oldham coupling 242. The scroll wraps 80 and 100 form the series of compression chambers C in which suction pressure fluid, drawn from suction area SP, is compressed. A portion of such fluid, at an elevated pressure in one such pocket, is directed through pressure fluid passage 240 into chamber 232.

The pressure in chamber 232 forces seal 230 into sealing engagement with planar surface 151 of pressure plate 150 which, in turn, causes the pressure fluid in chamber 232 to urge idler scroll 78 toward drive scroll member 76. In this manner the separation and tipping forces which are the result of the compression process occurring between the interleaved scroll members are counteracted and leakage between adjacent compression pockets across the tips of the scroll wraps is prevented or minimized.

As scroll members 76 and 78 rotate, pickup member 220 picks up lubricant from lower sump 224. Lubricant flows through passage 221 into circumferential groove 223 of member 220 and thence into lubricant passage 200 which is in registry therewith through depending passage 225 in the idler scroll member. A portion of the lubricant flowing into and through passage 200 is discharged through outlet 202 in the upper surface of the idler scroll member thereby lubricating the interface between surface 101 of idler end plate 102 and the tip 244 of opposed scroll wrap 80. An additional portion of the lubricant is discharged from passage 200 through branch passage 203 onto surface 151 of pressure plate 150.

As has been indicated, seal 230 is urged firmly into engagement with planar surface 151 of compression plate 150 by the pressure in chamber 232. This engagement and the relative orbital motion of the surface 151 of compression plate 150 results in a need to lubricate the interface between seal 230 and pressure plate surface 151. To accomplish the necessary lubrication, branch passage 203 is located such that the lubricant passing through it is deposited onto surface 151 of the pressure plate radially inward of seal 230 and is sized to meter a predetermined quantity of lubricant onto the pressure plate surface. The centrifugal force generated by the rotation of the scroll member 76, to which plate 150 is affixed, causes the lubricant deposited on surface 151 to flow radially outward toward seal 230.

The relative movement of seal 230 on pressure plate surface 151 opposes the outward flow of the lubricant on pressure plate 150 caused by centrifugal force. The lubricant impinges on first leg 227 of seal 230 and a portion of it is swept thereunder. Centrifugal force and the relative motion of seal 230 continues to act on the lubricant and causes the to continue its radially outward flow until it impinges on second leg 228. The lubricant is swept under leg 228 to complete the lubrication of the interface of seal 230 with surface 151 and is then flung radially off of the pressure plate into lower sump 224.

Lubricant pickup member 220 will preferably be molded from an engineered material such as plastic and may have one or more depending blade members 250 in which inlets 222 and passages 221 are defined. Inlet 222 is preferably defined in a slanted surface 252 of blade 250 which facilitates the pickup and delivery of lubricant from sump 224. Pickup member 220 is pressed into a trepanned groove 231 in undersurface 152 of idler scroll member 78 and, by its nature and location, forms a barrier between the area radially external of thrust bearing 160 and pressure biasing seal 230.

As is indicated above, seal 230, in the embodiment of FIG. 4, is of a vented design such that pressure chamber 232 is defined by the areas both above and below span 229. As such, the pressure assists in the balancing of forces on seal 230. In the case of a vented seal, it will be appreciated that leg portions 227 and 228 of seal 230 must themselves form a seal with respect to pressure responsive surface 151 of pressure plate 150 to prevent the leakage of pressure from pressure chamber 232 into suction pressure portion SP of the compressor shell.

The interface between leg portions 227 and 228 of seal 230 and pressure responsive surface 151 is dynamic in that seal 230 moves with respect to pressure responsive surface 151 when the compressor is in operation. It is therefore particularly critical in the case of a vented seal to protect seal 230 and its leg portions from damage due to the deposit of debris onto surface 151 of pressure plate 150.

In that regard, lubricant pickup member 220 has an integral flange 254 which extends radially outward beyond the inner edge 159 of the aperture 158 of pressure plate 150. The upper planar surface 256 of flange 254 rotates in close proximity to undersurface 258 of pressure plate 150. As such, unitary lubricant pickup member 220, in addition to providing for the delivery of lubricant to predetermined locations within compressor 20, acts to shield and protect surface 151 of pressure plate 150 and seal 230 from debris, such as particles of thrust bearing 160 or other debris which makes its way into lower sump 224, which might otherwise be splashed or carried onto surface 151 of pressure plate 150.

Figure 6:
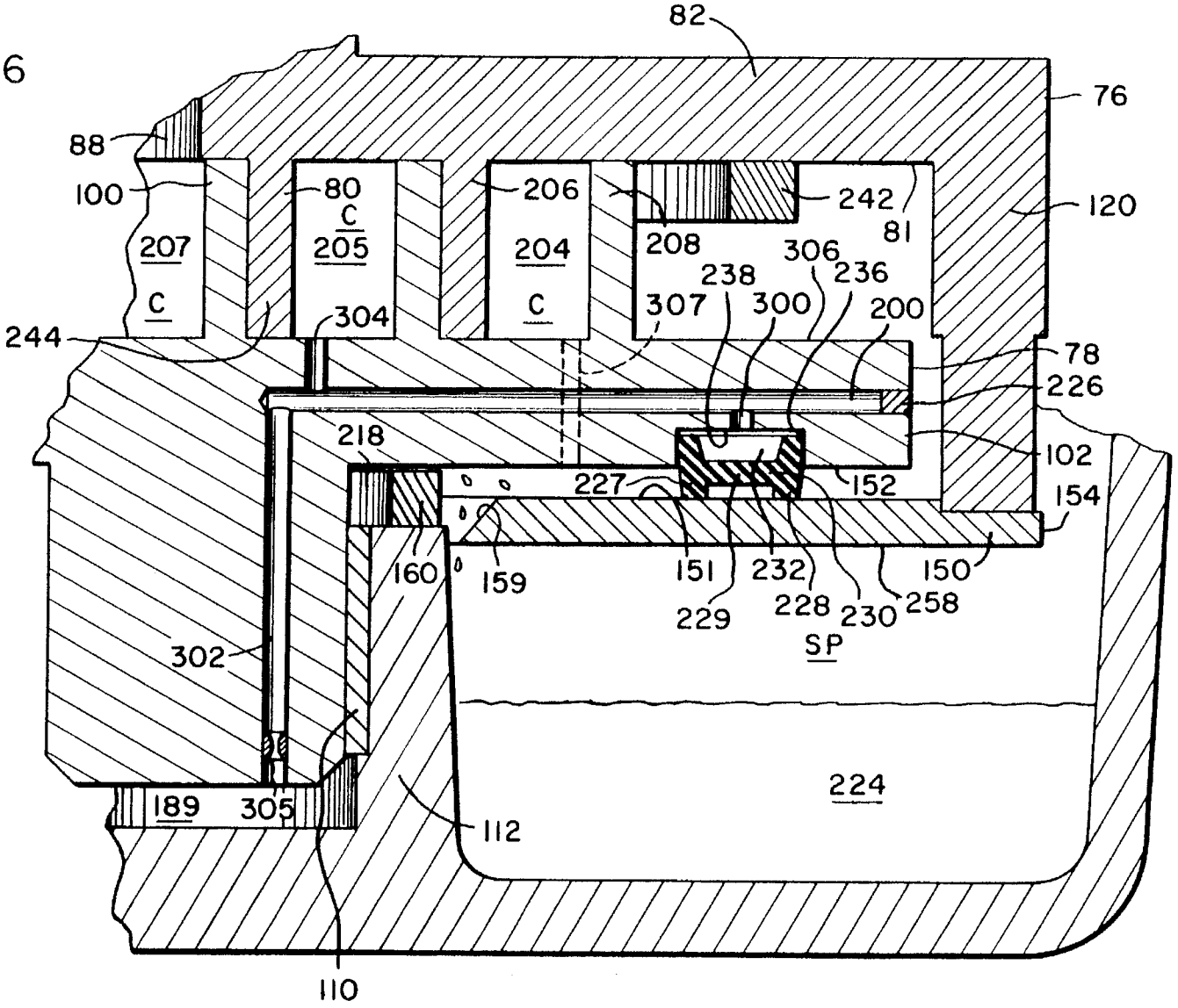
FIGS. 6 is an alternative embodiment to the embodiment illustrated in FIGS. 1 through 5.

Referring now to the alternative embodiment of FIG. 6, it will be appreciated that by a slight modification the medium used to actuate the pressure biasing arrangement can be made to be lubricant as opposed to compressed gas. It will be noted that the component reference numerals in FIG. 6 (as well as FIGS. 7, 8 and 9) refer to the same components as are referred to with respect to FIGS. 1–5, other than with respect to newly introduced reference numerals. It is further to be noted and understood that novel aspects of the FIG. 6 embodiment not associated with the change in the medium used to actuate the pressure biasing arrangement are applicable equally with respect to the embodiment of FIG. 4 in which compressed gas is directed into pressure chamber 232 for actuation purposes.

In the embodiment of FIG. 6 a branch passage 300 descends from lubricant passage 200 in idler scroll member 78. Passage 300 also opens into pressure chamber 232 defined by the idler scroll member and annular seal 230. Lubricant is therefore utilized to actuate the pressure biasing arrangement of the compressor rather than gas. The pressure in chamber 232 can be controlled in a number of ways such as by venting of the chamber to a relatively lower pressure compressor location through a restricted passage (not shown).

Lubricant passage 200, in the embodiment of FIG. 6 is in flow communication, through passage 302, with volume 189 beneath idler scroll stub shaft 104. As will be recalled, the lubricant in volume 189 is at discharge pressure having been communicated thereto from discharge pressure sump 180.

In the embodiment of FIG. 6, lubricant inlets 216 and 222 to lubricant passage 200 of the FIG. 4 embodiment are eliminated in favor of inlet 302 in stub shaft 104. It is also to be noted that in the embodiment of FIG. 6, the lubricant passage outlet 202 of FIG. 4 is eliminated in favor of a radially innermore passage 304 which opens into intermediate pressure compression chamber 205.

Discharge pressure lubricant in the embodiment of FIG. 6 is communicated from area 189 through inlet 302 and then, through a pressure reducing restriction 305, into lubricant passage 200. A portion of the lubricant makes its way through passage 304 into compression chamber 205 between the scroll members and onto the floor 306 of idler scroll member 78 to lubricate the interface between the tip 244 of involute 80 of the drive scroll member and the end plate 102 of the idler scroll member. The lubricant is also delivered from passage 200 into pressure chamber 232 where it acts as the medium which actuates the seal 230 of the pressure biasing arrangement of compressor 20. By the appropriate sizing of restriction 305 in passage 302, the pressure with which seal 230 is actuated by lubricant flowing into passage 200 can be controlled by the pressure in the compression chamber into which passage 304 opens.

Among the advantages of the embodiment of FIG. 6 is that the lubricant flowing into passage 200 is directed both into pressure chamber 232, where it assists in the internal lubrication, cooling and sealing of the pressure biasing seal member, and into a compression chamber where it assists in the lubrication of the scroll elements and the cooling of gas undergoing compression. The need for the gas passage 240 by which pressure chamber 232 of the FIG. 4 embodiment is pressurized, is eliminated.

Of particular significance with respect to the embodiment of FIG. 6 is the fact that seal 230 is of the unvented type referred to above. That is, span 229 of seal 230 is solid and does not define an aperture. As such, pressure communicated into pressure chamber 232 resides only above span 229 of seal 230. The criticality of preventing damage to legs 227 and 228 from debris is therefore reduced since the dynamic interface between legs 227 and 228 and pressure responsive surface 151 is no longer one which must form a seal between pressure chamber 232 and the suction pressure portion SP of the compressor shell.

In the case of the non-vented seal of FIG. 6, the need to lubricate the interface between legs 227 and 228 in pressure surface 151 so as to minimize friction and wear becomes the more significant factor. Therefore, in the embodiment of FIG. 6, lubricant pickup member 220 of the FIG. 4 embodiment is dispensed with and inner edge 159 of aperture 158 is chamfered in a manner which assists in the lubrication of pressure responsive surface 151 of the pressure plate.

In that regard, oil which makes its way passed thrust bearing 160 after having passed through lubricant collection chamber 218 is flung radially outward. To the extent it impinges on chamfered surface 159 it is directed upward and outward into the gap defined between pressure responsive surface 151 and the underside 152 of the idler scroll member. As such, chamfered surface 159 assists in the lubrication of seal 230 while still forming a protective barrier against the deposit of debris onto pressure responsive surface 151 with respect to debris which may make its way into sump 224.

Additionally, since seal 230 acts as a barrier to the further radially outward movement of lubricant and since such lubricant is subjected to centrifugal forces by the rotation of the idler scroll member and pressure plate, a lubricant passage 307, shown in phantom in FIG. 6, can be defined which penetrates end plate 102 of the idler scroll member. This permits the forced flow of such lubricant to the floor 306 of idler scroll member 78 for the purpose of lubricating the interface between the tip 244 of the involute wrap 80 of drive scroll member 76 and floor 306 of the idler scroll member.

Figure 7:
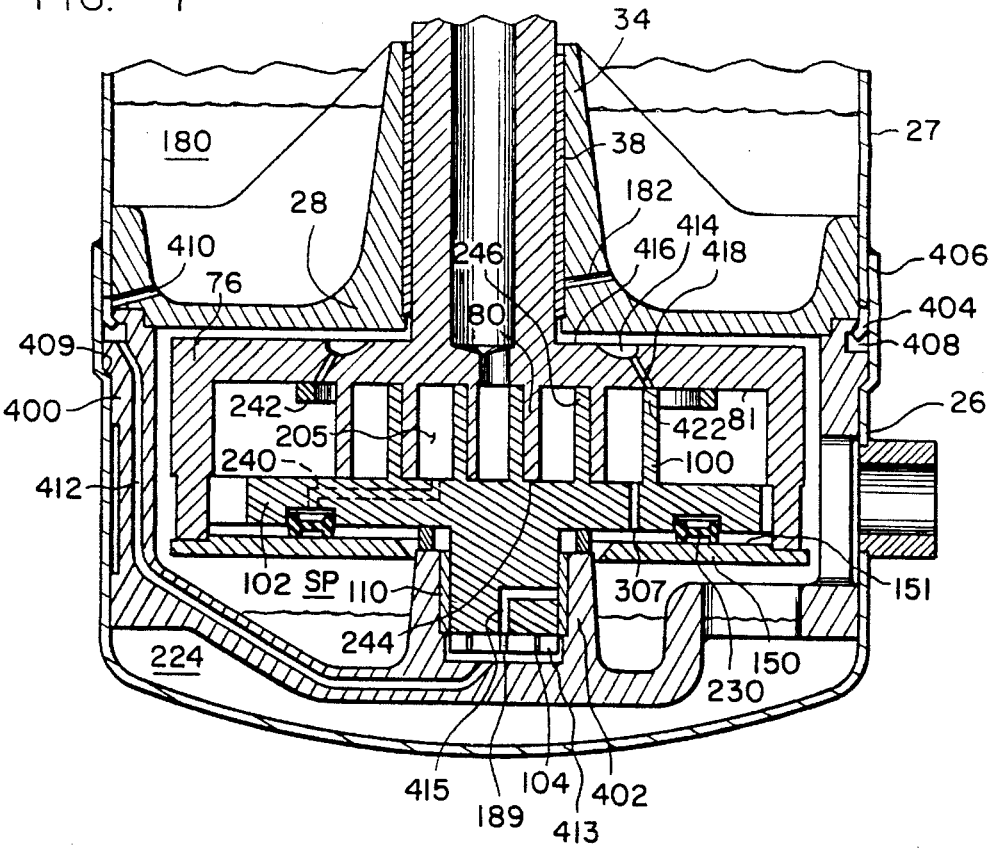
FIG. 7 is an additional embodiment illustrating an alternative oil source/flow arrangement.

Referring now to the embodiment of FIG. 7, different means for supplying discharge pressure lubricant from sump 180 to space 189 are illustrated as is a modification to drive scroll member 76 which permits the lubrication of the interface between tip 246 of involute 100 of idler scroll member 78 and end plate 82 of the drive scroll member. In the embodiment of FIG. 7, lubricant feed tube 186 of the FIG. 3 embodiment is disposed of in favor of an integral passage defined within the structure of compressor 20. The embodiment of FIG. 7 also differs from embodiment of FIG. 3 by its use of a discrete lower frame portion 400 which has an integral lower bearing housing 402.

In the embodiment of FIG. 7, central shell 27 has radially spaced apart tabs 404 which engage the lower frame 400 so as to hold the central and lower frame portions in axial alignment and contact during the assembly process. Lip 409 of expanded portion 406 of the lower shell seats on an accommodating surface of lower frame 400 thereby positioning lower shell 26 for welding to central shall 27 which likewise facilitates the compressor assembly process.

It is to be noted that expanded portion 406 of lower shell 26 is welded to central shell 27 in a manner such that a circumferential space or passage 408 is defined at the radial periphery of the compressor. One or more suitably spaced bores 410 in central frame 28 then communicate between discharge pressure oil sump 180 and circumferential passage 408 intermediate adjacent ones of tabs 404 of shell 27. Circumferential passage 408 is, in turn, in flow communication with lubricant passage 412 which is integrally formed in lower frame portion 402 and which opens into space 189 beneath stub shaft 104 of the idler scroll member.

The advantages of the arrangement of FIG. 7 are several. First, where a discrete lower frame is employed in conjunction with a central frame portion, the lower frame will typically be rotated at assembly with respect to the central frame portion to adjust the axis offset of the scroll members 76 and 78 of the compressor. With respect to FIG. 7, it will be appreciated that adjustment of the axis offset during compressor assembly, where the circumferential lubricant passage 408 of the FIG. 7 embodiment is created by the mating of the compressor components, is facilitated because there will be no need to directly align lubricant bore 410 in central frame 28 such that it is in direct registry with a lubricant passage in the lower frame. The lubricant distribution arrangement of FIG. 7 through its use of a circumferential oil passage is, therefore, one which facilitates and is very tolerant of the compressor assembly process.

Next, by the use of lip 409 to support lower frame 400 and by the use of circumferential passage 408 as a flow path through which discharge pressure lubricant passes, an extremely effective high to low side seal between the discharge and suction pressure portions of the compressor shell is created. That is, discharge pressure, acting on lower frame portion 400 through central frame portion 28 assists in the formation of a tight high to low side seal between lower frame portion 400 and lip 409.

Further, since circumferential passage 408 is filled with discharge pressure lubricant when the compressor is in operation, a high to low side fluid seal is created between the frame and shell portions of the compressor which further prevents the leakage of discharge pressure gas from the discharge pressure portion of the shell to the suction pressure portion of the shell. This arrangement is advantageous as compared to other arrangements where the compressor frame and shell portion interface might otherwise be less of a barrier to the leakage of gas from the discharge to the suction pressure portions of the compressor.

It will be noted that in the embodiment of FIG. 7 the use of a non-vented seal 230 in the pressure biasing arrangement in conjunction with the use of intermediate pressure gas communicated from intermediate pressure chamber 205 to actuate the seal is illustrated. It is also to be noted, with respect to FIG. 7, that the disposition of a schematically illustrated lubricant pump 413, driven by stub shaft 104 of the idler scroll member, in space 189 is suggested. The use and disposition of a positive displacement pump in such a fashion, while not mandatory, may be advantageous from a compressor protection standpoint.

In that regard, in certain failure modes, such as the breakage of the compressor discharge line, the pressure in discharge pressure sump 180 might drop to an extent such that insufficient pressure exists to drive lubricant from discharge pressure sump 180 to lower bearing 110 with catastrophic results to the compressor. By disposing a lubricant pump in space 189, which is driven by the idler scroll member, insurance is gained that adequate lubricant will be available, by a mechanical pumping process, to lower bearing 110 in the event of a loss in discharge pressure in a discharge pressure portion of the compressor shell. Pump 413 will preferably be any one of many types of positive displacement pumps typically used in such applications. It is to be noted that it would also be possible for pump 413 to be a pump of other than the positive displacement type such as a pump which employs centrifugal force to deliver oil to the required location such as through passage 415 to lower bearing 110.

Still further with respect to FIG. 7, it will be appreciated that by casting a lubricant passage into lower bearing housing 402, the need to drill relatively long small diameter bores to accomplish lubricant distribution in the compressor is eliminated. Further, by eliminating a separate tubular member connecting the discharge pressure sump 180 to volume 189, more space is made available within the immediate area of the rotating elements in the suction pressure portion of the compressor shell to accommodate the rotation of those components.

It will also be appreciated, with respect to the embodiment of FIG. 7, that pressure plate surface 151 is lubricated in a manner similar to that discussed with respect to FIG. 6 where lubricant impacting a chamfered pressure plate surface is deflected onto the pressure responsive surface of the pressure plate. In the embodiment of FIG. 7 however, discharge pressure lubricant from sump 180 is directed through passage 412 into area 189 and thence through passage 415 solely for the purpose of lubricating lower main bearing 110. Discharge pressure lubricant is not therefore, in the embodiment of FIG. 7, employed for the purpose of lubricating the interface between idler end plate 102 and the tip 244 of opposed scroll wrap 80. It is contemplated, however, and must be understood, that the discharge pressure lubricant from sump 180 could be used with respect to FIG. 7, in much the same manner as is suggested in the FIGS. 1–6 embodiments.

Still with respect to FIG. 7, it will be appreciated that by machining a groove 414 into the upper surface 416 of drive scroll member 76, lubricant which makes its way from sump 180 through bore 182 in upper bearing housing 34 and past upper main bearing 38 makes its way onto upper surface 416 of the drive scroll member can be further used for compressor lubrication purposes prior to being delivered to low pressure sump 224. Such lubricant is urged radially outward on surface 416 by the rotation of the drive scroll member and enters groove 414 defined in that surface. By means of one or more passages 418 communicating between groove 414 and surface 81 of the drive scroll end plate from which the drive scroll wrap extends, lubricant is made available both to Oldham coupling 242 and at the interface of drive scroll end plate surface 81 with tip 422 of involute wrap 100 of the idler scroll member.

Figure 8:
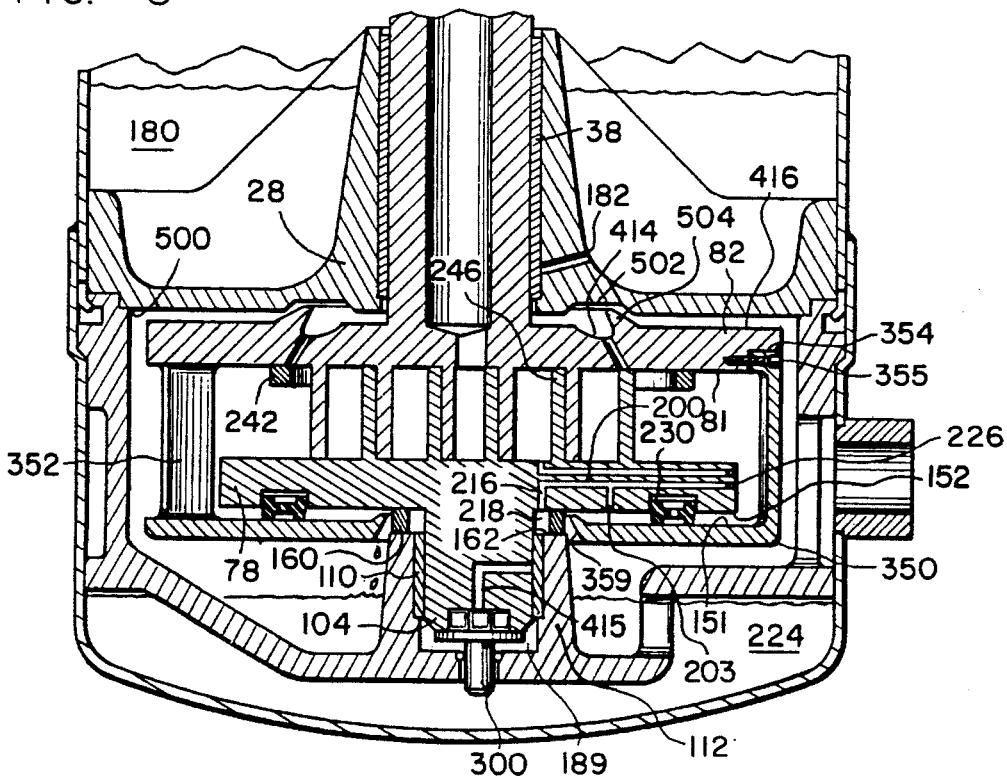
FIG. 8 is still another embodiment illustrating the lubrication of the idler scroll bearing by a positive displacement pump and the pressure plate to seal surface by a lubricant pickup member.

Referring now to the embodiment of FIG. 8, a pump 300 of the centrifugal or positive displacement type is driven by idler scroll member 78 in a manner which causes oil to be pumped from low pressure sump 224 into volume 189 and thence through passage 415 to lubricate lower main bearing 110. The use of a positive displacement pump for lower main bearing lubrication purposes as is set forth above may be advantageous over a bearing lubrication arrangement which relies on a differential pressure, such as between suction and discharge pressure, to provide lubricant to the lower main bearing. Through the use of a positive displacement pump to lubricate the lower main bearing with lubricant from low pressure sump 224, compressor survivability is enhanced and the requirement to provide a flow path from discharge pressure sump 180 to specific locations in the suction pressure portion of the shell is eliminated.

Most significant, with respect to FIG. 8, however, is the use of a vented seal 230 in the pressure biasing arrangement and the modification of pressure plate 350 by which seal 230 is protected from the deposit of debris onto pressure responsive surface 151. As is noted above, with the use of a vented seal, protection of the seal to pressure plate interface becomes extremely important. Therefore, inner edge 359 of pressure plate 350 is modified so as to extend upwardly of pressure responsive surface 151 into close proximity with undersurface 152 of idler scroll member 78.

Although not illustrated, as with the vented seal in the embodiment of FIG. 4 and assignee's U.S. Pat. No. 5,129,798, incorporated by reference hereinabove, vented seal 230 is capable of being biased by the delivery of lubricant or gas sourced from a number of locations within compressor assembly 20. In the event lubricant is used to bias a seal 230, the logical source for such lubricant would be pump 300 which would necessitate the extension of passage 415 into contact with a passage similar to passage 200 in the embodiment of FIG. 6. Seal 230, in that case, would be lubricated by the oil which is directed into its interior for pressure biasing purposes. In the event gas is used to bias seal 230, the logical source of such gas would be a compression pocket. That, in turn, would require the extension of passage 415 into flow communication with passages such as passages 200 and 203. In either case, whether gas or lubricant is the medium by which seal 230 is biased, by the extension of passage 415 in FIG. 8, lubricant is capable of being delivered directly to or radially inward of seal 230 for lubrication purposes as has been set forth with respect to other embodiments hereinabove. For example, passage 200 having inlet 216 can be defined in idler scroll member 78 as can branch passage 203, all in the manner illustrated in FIG. 4. Like the embodiment of FIG. 4, lubricant passage 200 will be closed such as by a plug 226. Consistent with the teaching set forth in FIG. 4, lubricant at higher than suction pressure will make its way past bearing 110 and into lubricant collection chamber 218 which is defined by idler scroll member 78 and thrust bearing 160. Thrust bearing 160 is disposed on shoulder 162 of idler bearing housing 112.

The pressure differential between lubricant collection chamber 218 and the suction pressure of the compressor shell will cause lubricant to flow from collection chamber 218 through inlet passage 216, into lubricant passage 200 and out of lubricant passage 200 through branch passage 203. Such lubricant is deposited on surface 151 of pressure plate 350 and is urged radially outward by the rotation of pressure plate 350 to the interface of seal 230 with surface 151 where it is used in the lubrication thereof. Once again, it will be noted that other means for delivering lubricant to the interface of seal 230 and surface 151 of pressure plate 350 are contemplated and fall within the scope of the present invention. In the embodiment of FIG. 8, however, the oil so delivered would be delivered under the impetus of pump 300 as opposed to discharge pressure as illustrated in the earlier embodiments.

Surface 359 of pressure plate 350 is inclined in a downward and radially outward direction so as to deflect lubricant flowing past thrust bearing 160 downwardly and away from pressure responsive surface 151 of the pressure plate. As such, edge 359 of pressure plate 350 acts to shield pressure responsive surface 151 and legs 227 and 228 of vented seal 230 with respect to the deposit of debris onto the pressure responsive surface. Edge 359 therefore performs the protective function of lubricant pickup member 220 as has been described with respect to the embodiment of FIGS. 1, 3 and 4 above.

It is also to be noted, with respect to FIG. 8, that a modification to the arrangement of FIG. 7 by which lubricant is made available to the Oldham coupling 242 through end plate 82 of the drive scroll member is suggested. In FIG. 8, surface 500 of central frame 28 has an annular recess 502 within which upwardly extending lip 504 of the drive scroll member rotates. Lip 504 by virtue of its extension into recess 502 more effectively catches and directs lubricant into groove 414 of upper drive scroll member surface 416.

Lip 504 in conjunction with recess 502 acts as an effective barrier to the migration of lubricant radially outward on surface 416 of the drive scroll member and diverts essentially all of the lubricant which flows from sump 180 through passage 182 past upper bearing 38 into groove 414 in surface. 416 of the drive scroll member. The use of such lubricant in the lubrication of the interface between the tip 246 of the scroll wrap of the idler scroll member with surface 81 of the drive scroll member and in the lubrication of the Oldham coupling 242 is thereby maximized.

As will be appreciated with respect to both the FIG. 7 and FIG. 8 embodiments, advantageous use of oil which has already been used for the purpose of bearing lubrication is made in the lubrication of the interface between the undersurface 81 of the drive scroll member and the tips of the involute of the driven scroll member and to lubricate the Oldham coupling. Such usage is accomplished without the need for sealed or closed chambers by which to trap such lubricant and/or for additional or discrete components, such as spring biased seals, for that purpose and which are subject to failure and/or which decrease compressor efficiency. In that regard, by a relatively simple machining process and/or the use of an appropriately cast rough blank for the driven scroll member, additional use is made of oil vented into the suction pressure portion of the shell and the centrifugal force which is imparted to it by the rotation of the drive scroll member in a more reliable and less expensive manner. As is illustrated in FIGS. 7 and 8, the passages which communicate through the end plate of the drive scroll member and out of groove 414 open onto surface 81 of the drive scroll member at a location which is at least cyclically at suction pressure. That is, the location of the openings is such that during at least one portion of the cycle of the compression process created by the relative orbital motion of the scroll members, such openings are in direct flow communication with suction pressure portion SP of the compressor shell. Therefore, no additional components or apparatus are needed to increase or maintain above suction pressure the oil delivered to the interface between the end plate of the drive scroll member and the tips of the wrap of the driven scroll member, the centrifugal force resulting from the rotation of the drive scroll member providing sufficient impetus for the delivery of such oil to that interface.

Referring finally now to FIGS. 8 and 9 concurrently, an alternative pressure plate arrangement to the arrangement of FIGS. 1, 3, 4, 6 and 7 is illustrated. In that regard, in the embodiment of FIGS. 8 and 9, the integral extension members 120 extending from idler scroll end plate 82 in the embodiments of FIGS. 1, 3, 4 and 6 are dispensed with in favor of a unitary pressure plate member 350 from which a plurality of legs 352 extend. Unitary pressure plate 350, like pressure plate 150 of the earlier embodiments, defines a pressure responsive surface 151 and aperture 158.

Legs 352 of unitary pressure plate 350 act as integral spacers which define the distance between surface 81 of drive scroll end plate 82 and pressure surface 151. Legs 352 each include a mounting portion 354 which is accommodated in end plate 82 for attachment therewith. The attachment of unitary pressure plate member 350 to end plate 82 may be accomplished by mechanical fasteners such as screws 355 or by other means such as by welding, adhesion or the like.

Although the present invention has been described in terms of several embodiments, it will be appreciated that the scope of the present invention is not to be limited other than in accordance with the teachings hereof and the language of the claims which follow. It should be understood that as of the patent application filing date hereof, no one embodiment of those described above have emerged as both a proven and preferred embodiment. In theory, the embodiment of FIG. 7 (preferably) without the use of pump 413) is preferred due to its relative simplicity and its more inexpensive manufacture. However, the embodiment of FIG. 7 has not been proven as viable for commercial applications. The embodiment of FIGS. 1, 3 and 4, on the other hand, employing lubricant pickup member 220 and a gas pressure biased biasing arrangement, has been successfully demonstrated in testing.

What is claimed is:

1. Co-rotating scroll apparatus comprising:

a shell having a suction pressure portion and a discharge pressure portion, said suction pressure portion defining a lubricant sump and said discharge pressure portion defining a lubricant sump;

a first bearing surface;

a second bearing surface;

a first scroll member having an end plate from which an involute wrap extends, said first scroll member being mounted for rotation in said first bearing surface;

a second scroll member having an end plate from which an involute wrap extends, said second scroll member being mounted for rotation in said second bearing surface, the wraps of said first and said second scroll members being interleaved;

means for causing the rotation of one of said scroll members;

means for drivingly coupling said first and said second scroll members; and means, having a pressure responsive surface, for pressure biasing said second scroll member toward said first scroll member, said means for pressure biasing said second scroll member towards said first scroll member including a unitary pressure plate, said pressure responsive surface being a surface of said unitary pressure plate, said unitary pressure plate including a plurality of legs extending therefrom and attached to said first scroll member, the length of said legs being determinative of the distance between said pressure responsive surface and said first scroll member end plate.

2. The scroll apparatus according to claim 1 wherein said means for causing rotation is an electric motor, wherein said means for drivingly coupling said first and said second scroll members is an Oldham coupling and further comprising a seal, said seal being disposed between the pressure responsive surface of said pressure plate and said second scroll member.

3. The scroll apparatus according to claim 2 wherein said seal is in moveable contact with said pressure responsive surface at an interface.

4. The scroll apparatus according to claim 3 further comprising means for lubricating the interface of said seal with said pressure responsive surface.

5. The scroll apparatus according to claim 4 wherein the interface of said seal and said pressure responsive surface is lubricated with lubricant deposited onto said pressure responsive surface.

6. The scroll apparatus according to claim 5 wherein said second scroll member defines a lubricant passage, lubricant for lubricating the interface between said seal and said pressure responsive surface flowing through said lubricant passage and being deposited onto said pressure responsive surface.

7. The scroll apparatus according to claim 6 wherein said pressure plate includes means for shielding said pressure responsive surface from the deposit of debris thereonto.

8. The scroll apparatus according to claim 7 wherein said pressure plate defines an aperture in said pressure responsive surface, said means for shielding said pressure responsive surface comprising the edge of said aperture, said edge of said aperture extending upwardly of said pressure responsive surface into the proximity of said end plate of said second scroll member.

9. The scroll apparatus according to claim 8 wherein said seal is a vented seal.

10. Co-rotating scroll apparatus comprising:

a shell having a suction pressure portion and a discharge pressure portion, said suction pressure portion defining a lubricant sump and said discharge pressure portion defining a lubricant sump;

a first bearing surface;

a second bearing surface;

a first scroll member having an end plate from which an involute wrap extends, said first scroll member being mounted for rotation in said first bearing surface;

a second scroll member having an end plate from which an involute wrap extends, said second scroll member being mounted for rotation in said second bearing surface, the wraps of said first and said second scroll members being interleaved;

means for causing the rotation of one of said scroll members;

means for drivingly coupling said first and said second scroll members; and means for lubricating an area of juxtaposition between the tip of the involute wrap of said second scroll member and the surface of said first scroll end plate from which the involute wrap of said first scroll member extends, said means for lubricating including a passage communicating through said first scroll end plate and annular lubricant collection means on the surface of said first scroll end plate which is opposite the surface from which the involute wrap of said first scroll member extends, said annular lubricant collection means being in flow communication with said passage and said passage opening on to the surface of said first scroll end plate from which said first scroll involute extends in the proximity of the tip of the involute wrap of said second scroll member, said annular lubricant collection means projecting above the plane of the surface of said first scroll member end plate.

11. The scroll apparatus according to claim 10 wherein said annular lubricant collection means comprises an annular groove defined in the surface of said first scroll end plate, the radially outer periphery of said groove projecting above the plane of the surface of said first scroll member end plate in which said groove is defined.

12. The scroll apparatus according to claim 11 wherein said scroll apparatus includes a frame separating said suction pressure portion from said discharge pressure portion of said shell, said frame defining a recess, the surface of said first scroll end plate in which said groove is defined being juxtaposed said frame, said projecting edge of said groove extending into said recess in said frame so that any lubricant urged radially outward toward said groove, after having first been delivered from said sump in said discharge pressure portion of said shell to said first bearing surface, is unable to avoid entry into said groove other than by entering said recess defined in said frame and passing around said projecting outer periphery of said groove.

* * * * *